US007757590B2

(12) United States Patent
Swartz

(10) Patent No.: US 7,757,590 B2
(45) Date of Patent: Jul. 20, 2010

(54) FASTENER HOLDING DEVICE

(76) Inventor: Darian Swartz, 4728 Heritage Drive, Vernon, BC (CA) V1T 7V4

( * ) Notice: Subject to any disclaimer, the term of this patent is extended or adjusted under 35 U.S.C. 154(b) by 0 days.

(21) Appl. No.: 11/744,652

(22) Filed: May 4, 2007

(65) Prior Publication Data

US 2007/0295173 A1 Dec. 27, 2007

Related U.S. Application Data

(63) Continuation-in-part of application No. 11/426,253, filed on Jun. 23, 2006, now abandoned.

(51) Int. Cl.
*B25B 23/08* (2006.01)

(52) U.S. Cl. ..... 81/451; 81/452; 81/900

(58) Field of Classification Search ..... 81/451, 81/452, 900

See application file for complete search history.

(56) References Cited

U.S. PATENT DOCUMENTS

| | | | | |
|---|---|---|---|---|
| 1,126,370 A | | 1/1915 | Borresen | |
| 2,516,311 A | * | 7/1950 | Ganz | 248/206.3 |
| 3,245,446 A | | 4/1966 | Morifuji | |
| 3,351,111 A | | 11/1967 | Biddle | |
| 4,167,347 A | * | 9/1979 | Hoyle | 401/88 |
| 4,221,429 A | | 9/1980 | Wade | |
| 4,526,072 A | * | 7/1985 | Manhoff, Jr. | 81/451 |
| 4,936,171 A | | 6/1990 | Berg | |
| 5,003,849 A | * | 4/1991 | Lawrie | 81/184 |
| 5,029,498 A | | 7/1991 | Kinsey | |
| 5,129,292 A | * | 7/1992 | Albert | 81/452 |
| 5,143,463 A | * | 9/1992 | Pozil et al. | 401/6 |
| 5,810,682 A | * | 9/1998 | Carruthers | 473/528 |
| 6,116,125 A | * | 9/2000 | McLeod | 81/456 |
| 6,128,982 A | * | 10/2000 | Gwin, Sr. | 81/452 |
| 6,363,818 B1 | | 4/2002 | Habermehl | |
| 2006/0083576 A1 | * | 4/2006 | Kanari | 401/54 |

* cited by examiner

*Primary Examiner*—D. S Meislin
(74) *Attorney, Agent, or Firm*—McGlew and Tuttle, P.C.

(57) ABSTRACT

The present invention relates generally to a fastener retaining system (FRS) and kit for securing a fastener (such as a screw) to a driver (such as a screwdriver) to facilitate one-handed use of the driver in both fastening and un-fastening operations.

17 Claims, 5 Drawing Sheets

FASTENER HOLDING DEVICE

CROSS-REFERENCE TO RELATED APPLICATION

This application is a continuation-in-part of U.S. patent application Ser. No. 11/426,253 filed Jun. 23, 2006, now abandoned.

FIELD OF THE INVENTION

The present invention relates generally to a fastener retaining system (FRS) and kit for securing a fastener (such as a screw) to a driver (such as a screwdriver) to facilitate one-handed use of the driver in both fastening and un-fastening operations.

BACKGROUND OF THE INVENTION

In the use of fastener-drivers (hereafter a "driver" or "drivers"), users often seek ways to ensure that the fastener remains fixed to the driver. More specifically, at many times, a user desires to use only one hand to apply pressure to the fastener as a result of the desired placement or location of the fastener. In situations where the desired placement of the fastener is on a vertical work surface or a work surface below the driver, the user must usually hold the fastener against the driver to ensure that it does not fall off the driver during positioning. Alternatively, the user must use steady hand movements while placing the fastener against the work surface. While some fasteners or drivers (such as a ROBERTSON™ driver and fastener) have specific surfaces or properties allowing the fastener and driver to remain gently attached to one another, the fastener may often fall off the driver if a critical angle is reached, the user inadvertently touches another surface with the fastener or as a result of unsteady hand or body movements by the user.

In the past, one solution to this problem has been the use of magnets within the driver which can increase the relative strength of connection between the driver and fastener. However, as a magnet requires that a corresponding fastener is magnetic, magnet tip drivers are limited to use with magnetic fasteners. Magnet tip drivers also have a tendency to pick up stray metal filings in and around work projects that must be periodically cleaned from the driver. Still further, magnet tip drivers are not suitable around magnet- and electrically sensitive areas where live wires may be employed. A magnet tip driver may also be unnecessarily bulky thereby limiting its use in certain applications.

Other past solutions have included screwstarters and screw guides. Screwstarters utilize either a spring-loaded or manually actuated multi-sectioned bit to apply opposing pressures to opposite sides of a fastener. However, these systems are limited to either a specific fastener style or a relatively small number of fastener styles. Moreover, these systems are relatively expensive compared to a single component driver. Screw guides are spring loaded rigid sleeves that are biased over the tip of a driver and that retract up and over the shaft as a fastener is advanced into a surface. These systems are generally limited to a particular size fastener head and are not interchangeable between different bits.

The prior art reveals that the use of flexible sleeves that engage with the shaft of a screwdriver have been proposed in various forms. While various embodiments of fastener holding devices are described within the prior art, the prior art does not disclose a fastener holding system that permits the use of a single fastener retaining system that can be effectively used with a wide-range of fastener head diameters and that ensures the effective capturing, centering and release of fasteners within the fastener holding device.

A review of the prior art reveals that such a system has not been previously disclosed. For example, U.S. Pat. Nos. 3,245,446, 4,221,429, 4,936,171, 3,351,111, 5,029,498, 1,126,370 each describe various screw holding devices that may be used to retain or hold a screw against a screwdriver. However, none of these references provide a system that enables the effective centering of a fastener within the system that ensures the effective centering of the fastener within the system or that are readily adapted for use with screwdriver shafts of different cross-sections.

SUMMARY OF THE INVENTION

In accordance with the invention, there is provided a system for retaining a fastener against a driver bit comprising: a resiliently flexible sleeve for frictional engagement against a driver shaft, the sleeve including at least three inwardly projecting arcuate leaflets adjacent a first end of the sleeve for engagement over and around the head of a fastener.

In a further embodiment, the leaflets abut each adjacent leaflet thereby defining an abutment region and wherein the abutment region extends greater than 50% of the distance between the sleeve and the central axis of the sleeve.

In another embodiment, each leaflet has a horizontal length extending from the sleeve that is less than the vertical displacement of each leaflet from the first end of the sleeve.

In one embodiment, the first end of the sleeve is inwardly tapered towards the leaflets thereby defining a volume radial to the leaflets for allowing a leaflet to fold into the volume during use.

In another embodiments, the sleeve has either a generally triangular cross-section that may be inwardly convex or a circular cross section.

In a more specific embodiment, the invention provides a system for retaining a fastener against a driver bit comprising: a resiliently flexible sleeve for frictional engagement against a driver shaft, the sleeve having a triangular cross section having three inwardly convex surfaces, the sleeve further including at three inwardly projecting arcuate leaflets adjacent a first end of the sleeve for engagement over and around the head of a fastener and wherein each leaflet has a horizontal length that is less than the vertical displacement of each leaflet from the first end of the sleeve.

Further still, the invention provides a driver for securing a sleeve as described wherein the driver includes a head having a recess for receiving and storing the sleeve.

BRIEF DESCRIPTION OF THE DRAWINGS

Embodiments of the invention will be described, by way of example with reference to the attached Figures, wherein.

DETAILED DESCRIPTION

With reference to the Figures, an elastic and flexible polymeric fastener retaining system (FRS) 10 is described for use in retaining fasteners 5 against the bit surfaces 11 of a driver 11*a*. The invention is described by way of two preferred embodiments.

Figure 1:
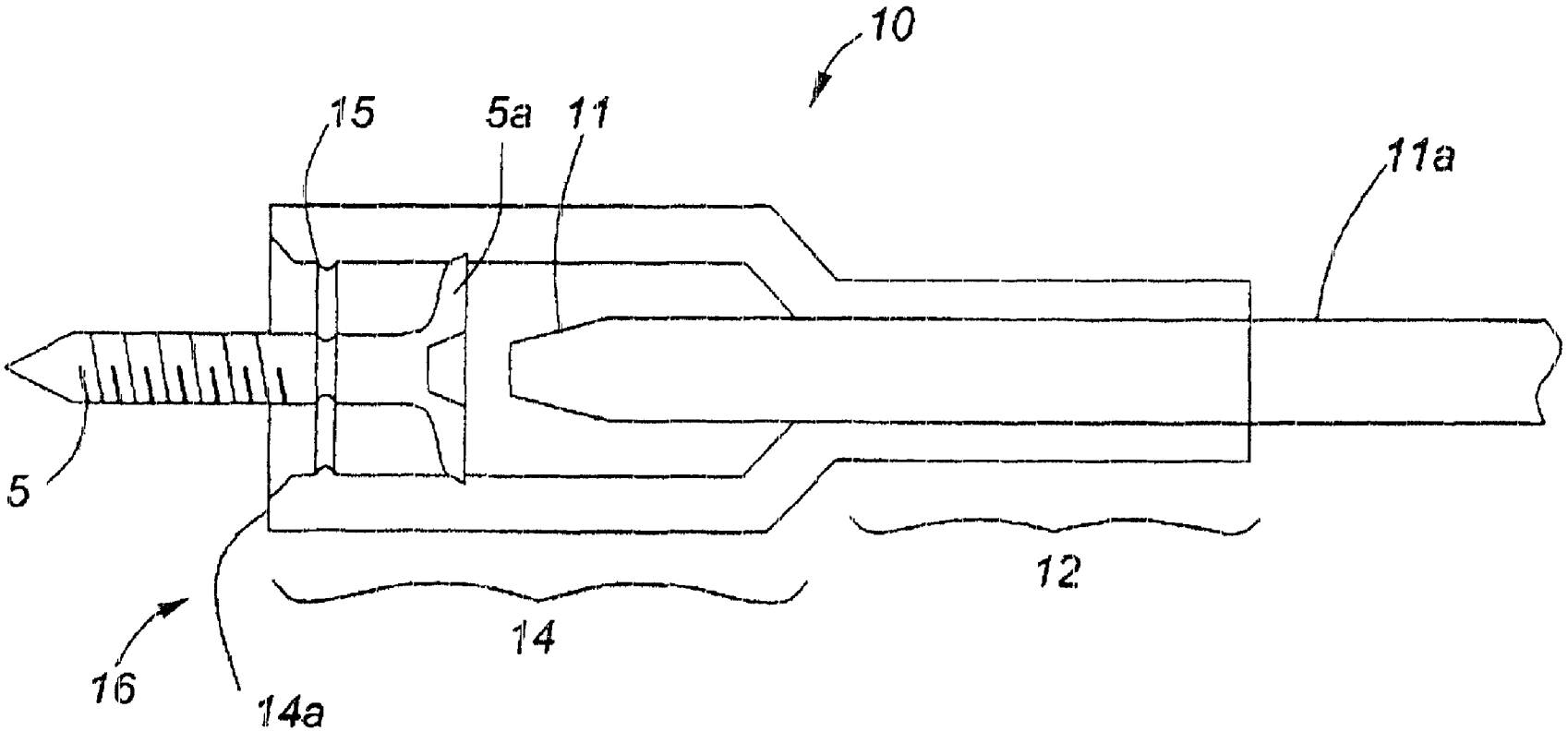
FIG. 1 is a cross-sectional view of a fastener holding system in accordance with one embodiment of the invention.

As shown in FIG. 1, the FRS 10 includes a sleeve 12 for frictional engagement around the shaft of a driver 11*a* (such as a screwdriver shaft) and a lower section 14 adapted for engagement with a fastener. In the embodiment shown in FIG. 1, the sleeve 12 generally has an inside diameter corresponding to the outer diameter of the driver shaft 11*a* while the lower section 14 has an inside diameter which allows the lower section 14 to be placed over the head 5*a* of a fastener 5.

Figure 2:
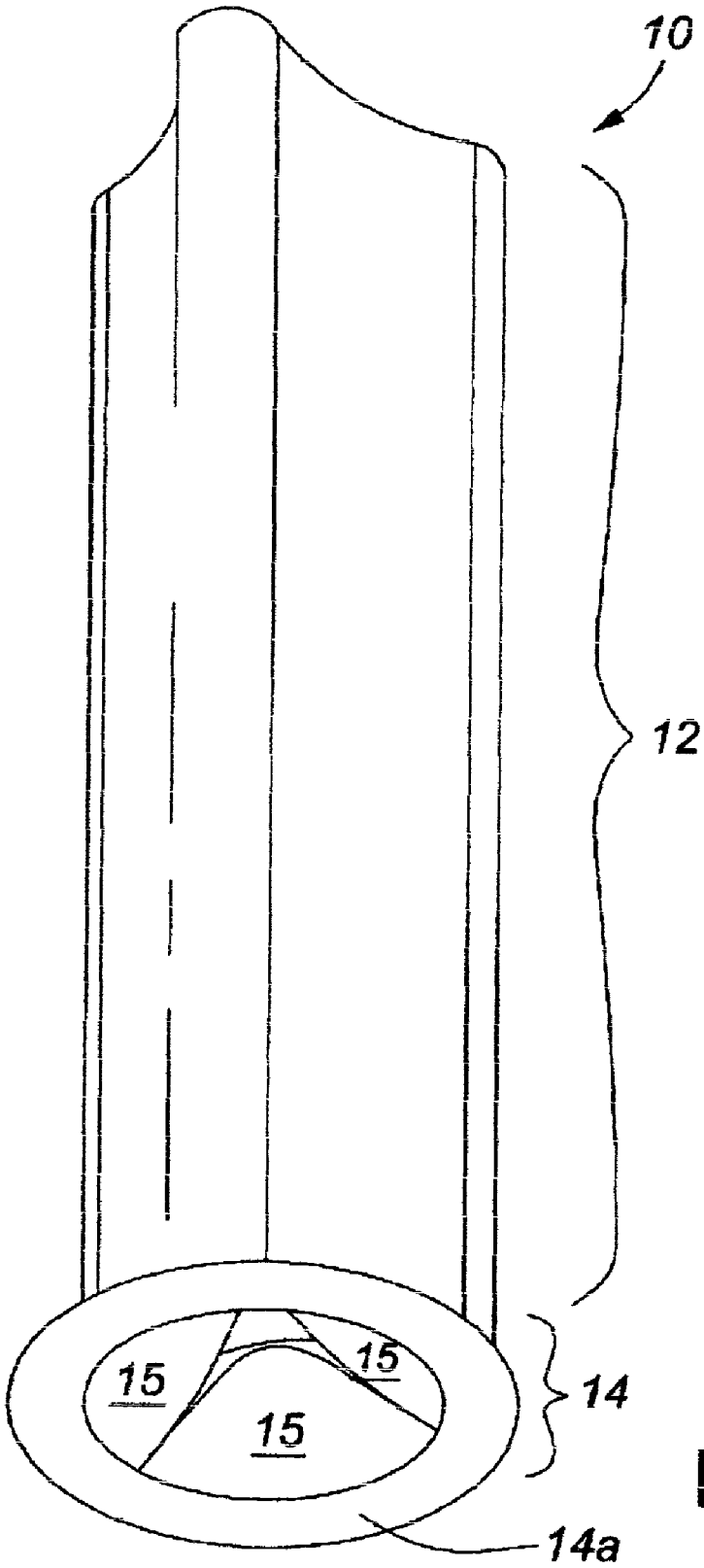
FIG. 2 is perspective view of a fastener holding system in accordance with one embodiment of the invention.
Figure 3:
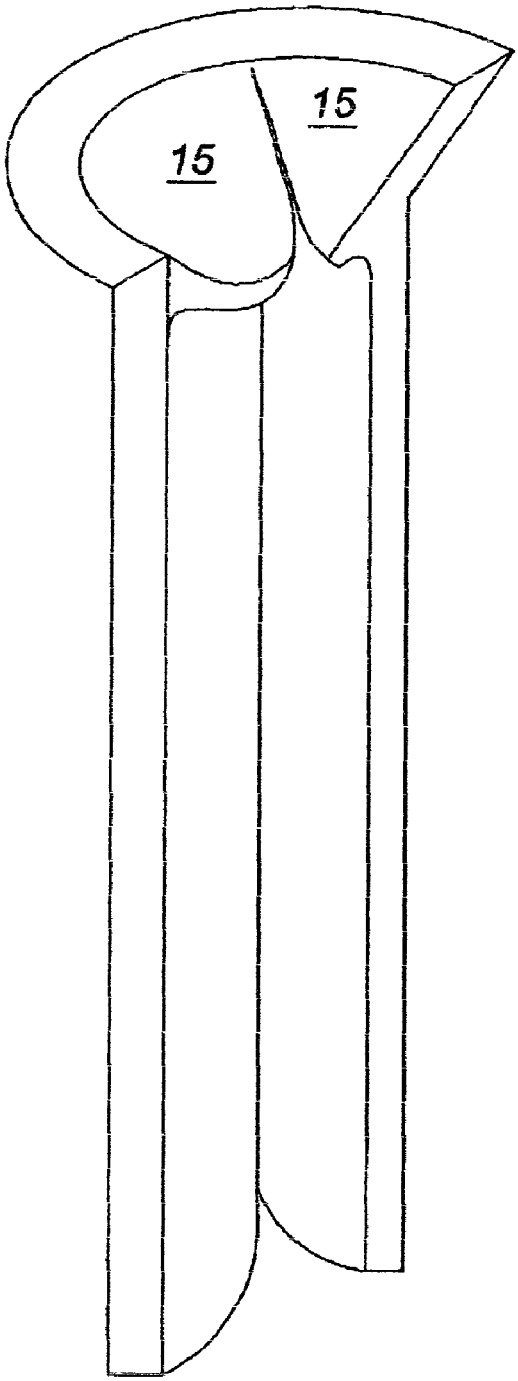
FIG. 3 is perspective and cross-sectional view of a fastener holding system in accordance with one embodiment of the invention.

In the embodiment shown in FIGS. 2 and 3, the sleeve 12 has a generally triangular cross-section.

In each embodiment, the inner surface of the lower section is provided with a fastener retaining system 16 comprising at least three leaflets 15 adjacent the lower edge 14*a*.

In operation, a user places the sleeve 12 over and around the shaft 11*a* of a driver and positions the lower edge 14*a* of the lower sleeve so that it protrudes slightly beyond the lower tip of the driver bit. A fastener 5 is inserted within the fastener retaining system so as to engage with the bit surface 11 where it is firmly held against the bit surface. By virtue of the leaflet design together with the elastic and flexible nature of the FRS, variations in fastener head and shaft diameters can be retained against a bit surface.

Lower Section

Figure 3A:
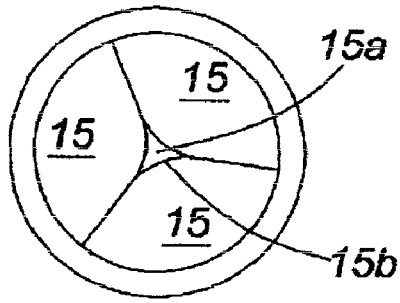
FIGS. 3A, 3B and 3C are end views of different leaflet configurations in accordance with various embodiments of the invention.
Figure 3B:
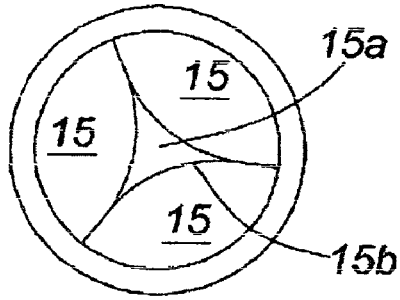
Figure 3C:
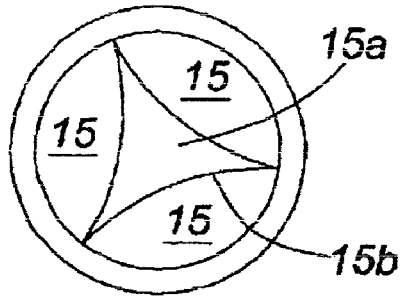
Figure 4:
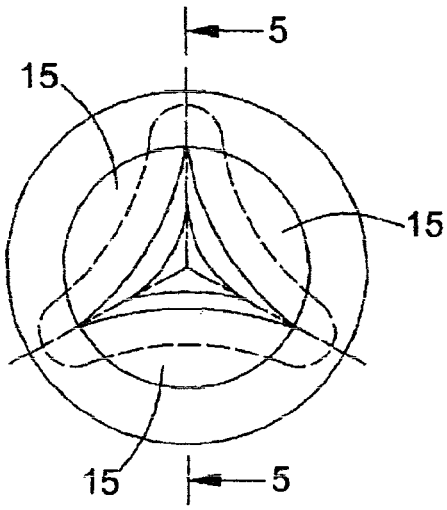
FIG. 4 is an end view of a fastener holding system in accordance with one embodiment of the invention.

As best shown in FIGS. 2, 3 and 4, the lower section 14 includes three generally arcuate leaflets extending inwardly from the inner surfaces of the shaft sleeve 12. The arcuate leaflets may have different radii as shown in FIGS. 3A, 3B and 3C whereby leaflets of different radii define openings 15*a* of varying area between the leaflets. As shown, the outer edge surface of each leaflet extends to the interior of the FRS wherein, depending on the radius of the leaflet, may abut the outer edge surface 15*a* of an adjacent leaftlet. That is, as shown in FIG. 3A, where the radii of each of the three leaflets is relatively small, the opening 15*a* is smaller and the outer edge surfaces 15*b* of the leaflets abut one another. In FIG. 3C, it can be seen that the radius of each leaflet is larger which results in a correspondingly larger opening 15*a* and a relatively smaller length of the outer edge surface that abuts an adjacent leaftlet.

Importantly, the arcuate structure of the leaflets, together with their elasticity, act to automatically center a fastener between the leaflets while also urging the fastener head against a driver bit. Moreover, and particularly for those structures where the leaflets minimize the space 15*a* as shown in FIGS. 3A and 3B, the FRS can be effectively used with a wide range of fastener head diameters and fastener shaft diameters. That is, a single FRS can be used with fastener heads ranging for example, from ½ inch diameter down to a $\frac{1}{8}^{th}$ inch diameter. Accordingly, and particularly when the FRS is used with a screwdriver having interchangeable bits, a single FRS can be used with a number of different size screwdriver bits ranging from larger size bits down to very fine or smaller bits.

Figure 5:
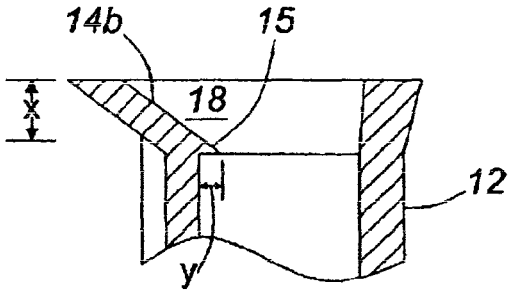
FIG. 5 is a cross-sectional view of the lower section of a fastener holding system in accordance with one embodiment of the invention.
Figure 7:
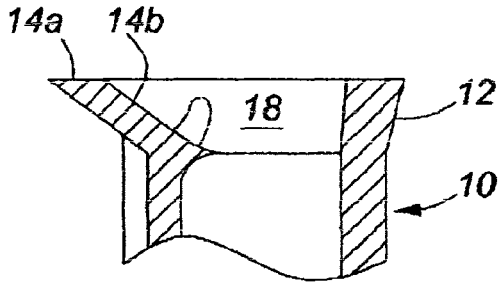
FIG. 7 is a cross-sectional view of the lower section of a fastener holding system in accordance with one embodiment of the invention showing a leaflet in folded position; and, FIG. 8 is a cross-sectional view of a driver head in accordance with an embodiment of the invention wherein the driver head has a recess for storing a sleeve.

As best shown in FIGS. 5 and 7, it is also preferred that the distal surface 14*b* of the lower section is outwardly tapered so as to provide a volume 18 for each leaflet to fold into as the a fastener head is passing through the leaflets during fastening. As shown in FIG. 7, a leaflet 15 may be folded into the volume 18 allowing the fastener head to pass through the leaflets without pinching the leaflets against a work surface. It is preferred that the vertical distance X between the underside of a leaflet 15 and the surface 14*a* is greater than the horizontal length Y of the leaflet.

It should be noted that the preferred number of leaflets is three. Other odd-numbered fastener retaining systems may be manufactured and provide the same centering properties of a three-leafed system. For example, five and seven leaflet systems are potentially practical embodiments. Systems with an even number of leaves will also work but are not preferred as the origin of various pairs of leaves and the central axis of the FRS will be aligned which may minimize the effectiveness of the system in providing the automatic centering functionality.

Sleeve 12

Figure 6:
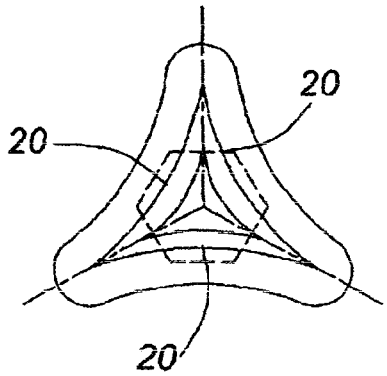
FIG. 6 is a cross-sectional view of the sleeve of a fastener holding system in accordance with one embodiment of the invention.

In a preferred embodiment, as best shown in FIGS. 2, 3 and 6, the sleeve 12 has a generally triangular cross section. The triangular cross section allows a single size fastener retaining system 10 to be used on a variety of driver diameters and cross-sections. With reference to FIG. 6, the sleeve is shown to include three inner surfaces 20. It is preferred that surfaces 20 are inwardly convex so as to permit the sleeve 12 to engage with both smaller diameter driver shafts where the sleeve remains inwardly convex as well as larger diameter shafts where, due to the elasticity of the sleeve, will expand outwardly so that the surfaces 20 become outwardly concave (not shown). Furthermore, by virtue of this design, the inwardly convex surfaces will effectively engage with shafts having a non-circular cross-section.

In particular, for drivers having a hexagonal cross-section, the FRS will effectively enable that each of the surfaces 20 will be engaged against three of the flat surfaces of the hexagonal shaft driver (shown schematically in dotted lines in FIG. 6) thus effectively preventing twisting of the sleeve around the hexagonal shaft.

Use

The FRS is most useful when a user either has a single or limited number of fastening jobs to complete within a confined or awkward space where the use of two hands to initiate the fastening process is difficult. For example, if a user is working within a confined space and cannot hold a fastener in one hand against the work surface while connecting the driver to the fastener, the FRS is particularly useful. In this scenario, a user would place the sleeve 12 over the shaft of the driver and position the FRS at the appropriate location along the shaft as described above. The fastener 5 would be inserted through the leaflets within the lower section and adjusted such that the fastener is retained against the bit surface. The user is then able to confidently use one hand to properly locate the fastener against the work surface, apply the fastening pressure and complete the fastening process.

In repeated use, where a user wishes to complete a larger number of fastenings using an identical fastener, after initially setting up the sleeve 10 in its proper position, the user can confidently complete each successive fastening while quickly and easily inserting a new fastener into the lower sleeve as each fastening is completed.

As the fastening process proceeds, the head of the fastener will begin to engage against the work surface. Due to the flexible and elastic nature of the lower sleeve and leaflets, as well as the tapering surfaces 14*b* of a typical fastener head as shown in FIGS. 1, 5 and 7, the leaflets will open and fold towards the work surface without pinching against the work surface. As the leaflets are cleared from the fastener head and the fastening process continues, the fastener will become fully engaged and/or countersunk against/within the work surface without damage to the leaflets.

However, it should be noted that over time, particularly with the use of electric drivers, the lower edge of the FRS may be worn out as a result of friction with the work surface. However, the FRS can be readily replaced with a new FRS. Naturally, the nature of the work surface will contribute to the longevity of a particular FRS where smoother surfaces where the abrasive forces are less will contribute to a longer life for a particular FRS.

The FRS may also be used in removing fasteners from work surfaces particularly where there is a risk of dropping the fastener as it is removed from the work surface. In this case, the above steps are performed in reverse with the result that when the fastener head has been withdrawn a distance sufficient to allow the leaflets to engage the fastener head, the leaflets will automatically "pop-over" and engage with the head so that by continued turning and eventual disconnection of the fastener with the work surface the leaflets retains the fastener.

Materials and Manufacture

The sleeve may be fabricated from polymeric materials having a range of properties. Typically, the sleeve will be manufactured in an injection molding process from any suitable elastic polymeric material such as but not being limited to nylons, rubbers, PVCs and polyurethanes that allow the sleeve to perform the desired functions of gripping both the shaft and fastener. In one embodiment the sleeve is a clear or partially clear silicone polymer so as to allow the user to observe the positioning and degree of engagement between the fastener head and the bit during both initial set up and repeated use. Durometer values of 60-80 are particularly beneficial The polymeric material may also be manufactured with luminescence which may assist in illuminating a dark work area or be colour coded or imprinted with a symbol(s) to allow a user to quickly identify a driver type.

Further Embodiments

Figure 8:
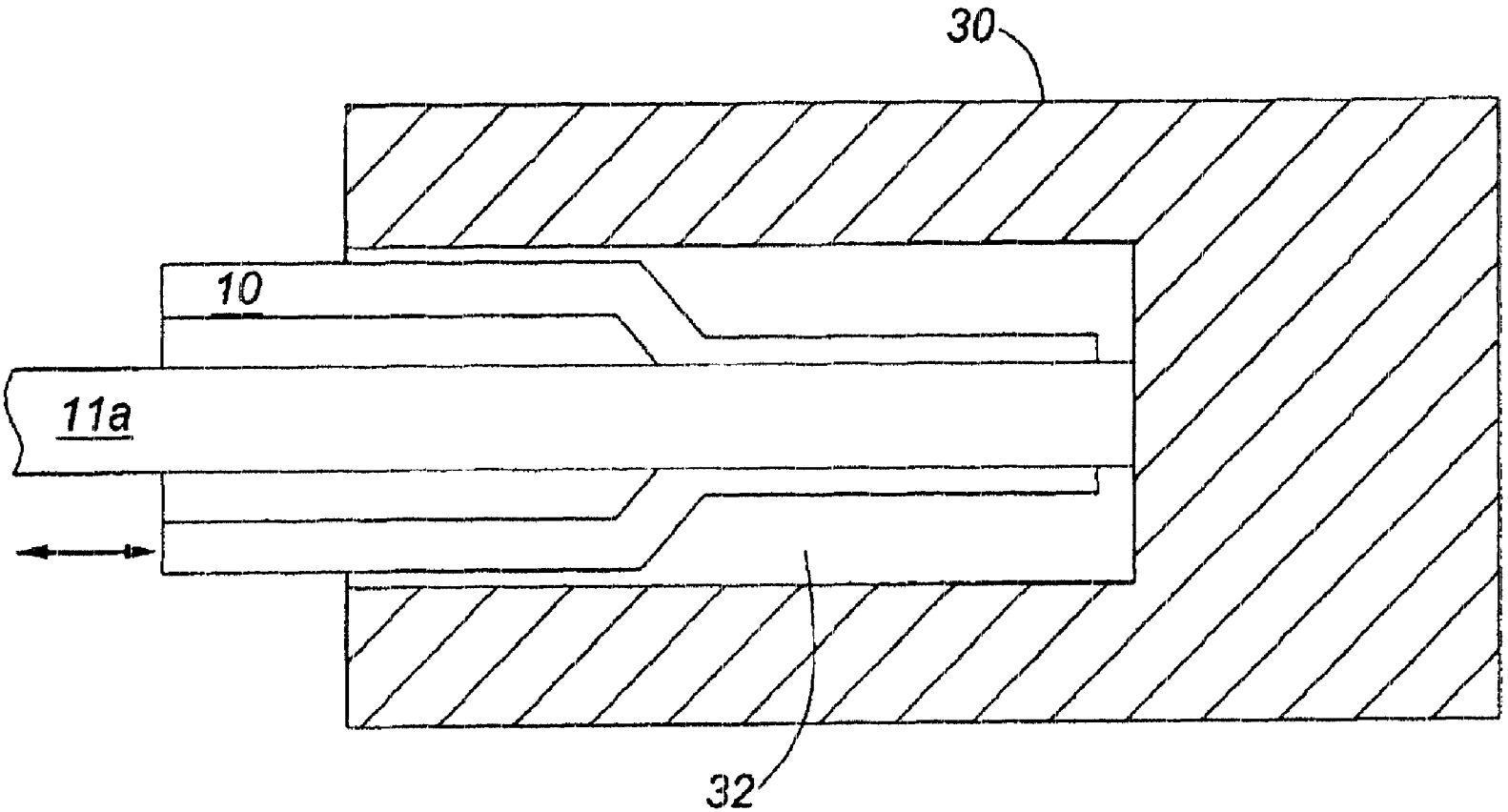

In a still further embodiment, the driver may be modified to allow the storage of a FRS within the head of the driver. With reference to FIG. 8, a typical driver head 30 is shown having a recess 32 for allowing the FRS to be withdrawn up the shaft and stored fully or partially within the driver head. In this embodiment, a user may push the FRS 10 up into recess 32 when the FRS is not required and then withdraw the sleeve from the recess by grasping a small protruding portion of the sleeve to slide the sleeve down the shaft 11*a* for use.

The FRS has been tested and found to be effective with a wide range of fastener types and head styles including PHILLIPS™, TORQ-SET™, TORX™, TORX PLUS™, TRI-WING™, hex, hex external, 12 pt (internal), 12 pt (external), Slotted, ROBERTSON™, clutch, POSIDRIVE™, TEKS™, FLORTORX™, TENSILOK™, Decorative Knurl, Tri-Angle, ROBERTSON™/Slotted, PHILLIPS™ (External Hex), Drilled Head, OPSIT, Truss, Binding, Fillistar, Oval, Round, Flat, Pan, Washer, Cheese, Cap, Button, Thumbscrew and Set-Screw Fasteners.

Further still, the FRS is effective in holding female style fasteners including nuts, caps, hex, bubble, serrated, pal, square, sleeve, barrel, MS, twist-off collars and TAMPRUF fasteners. In addition, the FRS is effective with sockets and can be particularly useful in holding both a washer and nut within a socket before tightening over a bolt.

As well, hose-clamps can be held positioned and tightened with the sleeve effectively holding the clamp for the procedure.

The above-described embodiments of the present invention are intended to be examples only. Alterations, modifications and variations may be effected to the particular embodiments by those of skill in the art.

The invention claimed is:

1. A system for retaining a fastener against a driver bit, the system comprising:

a resiliently flexible sleeve having an inner surface, a longitudinal axis and at least one driver shaft engaging surface for frictional engagement against a driver shaft having at least one driver shaft surface, the sleeve including at least three of an odd number of evenly-sized generally arcuate leaflets, the generally arcuate leaflets each having a generally arcuate outer edge extending inwardly from the inner surface of the resiliently flexible sleeve for engagement over and around the head of a fastener wherein the inwardly projecting generally arcuate leaflets are sized to promote centering a fastener within the system.

2. A system as in claim l, wherein the generally arcuate outer edges of adjacent leaflets abut adjacent generally arcuate outer edges of an adjacent leaflet thereby defining an abutment region and wherein the abutment region extends greater than 50% of the distance between the sleeve and a central axis of the sleeve.

3. A system as in claim 1, wherein the first end of the sleeve includes a distal surface outwardly tapered thereby defining a volume radial to the leaflets for allowing the generally arcuate outer edges of a leaflet to fold into the volume during use.

4. A system as in claim 1, wherein the sleeve has a generally triangular cross-section having three shaft engaging surfaces and wherein each shaft engaging surface is inwardly convex to enable the sleeve to be engaged with different size shafts.

5. A system as in claim 1, wherein the sleeve is manufactured from a clear material.

6. A system as in claim 5, wherein the sleeve is clear silicone rubber.

7. A system as in claim 1, wherein the sleeve is manufactured from a luminescent material.

8. A system as in claim 1, wherein the resiliently flexible material has a durometer value of 60-80.

9. A system as in claim 1, wherein the sleeve has a circular cross section.

10. A system for retaining a fastener against a driver bit, the system comprising:

a resiliently flexible sleeve for frictional engagement against a driver shaft, the sleeve having an inner surface, a longitudinal axis and a triangular cross section having three inwardly convex shaft engaging surfaces, the sleeve further including three evenly-sized generally arcuate leaflets each having a generally arcuate outer edge extending inwardly from the inner surface of the resiliently flexible sleeve for engagement over and around the head of a fastener and wherein each leaflet has a horizontal length from the inner surface of the sleeve to the longitudinal axis of the sleeve that is less than the vertical displacement of each leaflet from the first end of the sleeve.

11. A system for retaining a fastener against a driver bit, the system comprising:

a resiliently flexible sleeve portion with an outer surface and a driver shaft engaging inner surface for frictional engagement with an outer surface of a driver shaft, said sleeve portion having an upper driver shaft opening; and a resiliently flexible fastener engagement sleeve lower section formed integrally with said resiliently flexible sleeve portion, said sleeve lower section having a sleeve lower section outer surface forming a continuation of said sleeve portion outer surface having a sleeve lower section inner surface forming a continuation of said sleeve portion inner surface, said sleeve lower section having a lower edge defining a fastener opening for receiving a head portion of a fastener through said fastener opening and said sleeve lower section having at least three evenly-sized generally arcuate leaflets comprising an odd number of said generally arcuate leaflets connected to said sleeve lower section inner surface adjacent to said fastener opening, each of said generally arcuate leaflets projecting radially inwardly from said sleeve lower section inner surface toward a central axis of said sleeve lower section and having a generally arcuate outer edge extending inwardly from the lower section inner surface of the sleeve defining fastener centering means for engagement over and around the head portion for centering the head portion within said sleeve lower section and relative to said inner driver shaft engaging surface.

12. A system as in claim 11, wherein said resiliently flexible sleeve portion has a generally triangular cross-section wherein said driver shaft engaging inner surface includes three shaft engaging surface portions, each of said engaging surface portions being connected to two adjacent engaging surface portions at connection regions and being inwardly convex to define a variable shaft size engagement means with each engaging surface portion flexing relative to said connection regions for engagement of said engaging surface portions with different size driver shafts.

13. A system as in claim 12, wherein each generally arcuate outer edge of each of said generally arcuate leaflets abuts a generally arcuate outer edge of a first side adjacent generally arcuate leaflet to define a first side abutment region and each generally arcuate outer edge of each of said generally arcuate leaflets abuts a generally arcuate outer edge of a second side adjacent generally arcuate leaflet to define a second side abutment region and each abutment region extends more than 50% of a distance between said sleeve lower section inner surface and said central axis.

14. A system as in claim 13, wherein said sleeve lower section is inwardly tapered towards said leaflets for defining a volume radial to said leaflets for allowing respective said generally arcuate outer edges of said leaflets to fold into the volume during use.

15. A system as in claim 11, wherein each generally arcuate outer edge of each of said arcuate leaflets abuts a generally arcuate outer edge of a first side adjacent arcuate leaflet to define a first side abutment region and each generally arcuate outer edge of each said arcuate leaflets abuts a generally arcuate outer edge of a second side adjacent arcuate leaflet to define a second side abutment region and each abutment region extends more than 50% of a distance between said sleeve lower section inner surface and said central axis.

16. A system as in claim 15, wherein each leaflet has a radial length extending from said lower section inner surface that is less than an axial displacement range of each leaflet.

17. A system as in claim 13, wherein said sleeve lower section is inwardly tapered towards said leaflets for defining a volume radial to said leaflets for allowing respective said free inner arcuate edges of said leaflets to fold into the volume during use.

* * * * *